US009682310B2

(12) United States Patent
Ziran et al.

(10) Patent No.: US 9,682,310 B2
(45) Date of Patent: Jun. 20, 2017

(54) RANDOM OUTCOME GENERATOR FOR GAMES

(71) Applicant: National Entertainment Collectibles Association, Inc., Hillside, NJ (US)

(72) Inventors: Justin Ziran, Rutherford, NJ (US); Bryan Kinsella, Bainbridge Island, WA (US); Josh Piezas, Cranford, NJ (US); Alexis N. Mueller, Jersey City, NJ (US)

(73) Assignee: National Entertainment Collectibles Association, Inc., Hillside, NJ (US)

( * ) Notice: Subject to any disclaimer, the term of this patent is extended or adjusted under 35 U.S.C. 154(b) by 0 days.

(21) Appl. No.: 14/559,282

(22) Filed: Dec. 3, 2014

(65) Prior Publication Data

US 2015/0151194 A1 Jun. 4, 2015

Related U.S. Application Data

(60) Provisional application No. 61/911,234, filed on Dec. 3, 2013.

(51) Int. Cl.

| | |
|---|---|
| ***A63F 5/04*** | (2006.01) |
| *A63F 3/00* | (2006.01) |
| *A63F 11/00* | (2006.01) |

(52) U.S. Cl.

CPC ..... *A63F 5/048* (2013.01); *A63F 3/00697* (2013.01); *A63F 5/04* (2013.01); *A63F 5/045* (2013.01); *A63F 5/046* (2013.01); *A63F 2003/0076* (2013.01); *A63F 2003/00747* (2013.01); *A63F 2003/00826* (2013.01); *A63F 2011/0072* (2013.01)

(58) Field of Classification Search

CPC .... A63F 2003/0076; A63F 2003/00747; A63F 3/00697; A63F 5/048; A63F 5/046; A63F 5/045; A63F 5/04; A63F 2003/00826

USPC ... 273/142 R, 142 J, 142 JA–142 JD, 142 K, 273/288, 289, 148 R

See application file for complete search history.

(56) References Cited

U.S. PATENT DOCUMENTS

| | | | | |
|---|---|---|---|---|
| 5,382,023 A * | 1/1995 | Roberts | A63F 11/0011 | 273/142 H |
| 6,918,590 B2 * | 7/2005 | Annis | A63F 3/00697 | 273/142 H |
| 2004/0051244 A1 * | 3/2004 | Weisman | A63F 3/00697 | 273/262 |
| 2014/0084542 A1 * | 3/2014 | Ziran | A63F 3/00697 | 273/288 |

* cited by examiner

*Primary Examiner* — Benjamin Layno

(74) *Attorney, Agent, or Firm* — McCarter & English, LLP

(57) ABSTRACT

A random outcome generator for games is provided herein. The random outcome generator for games comprises a base having a bottom wall defining a finger therein including a stopper extending from a top surface thereof, the finger being pivotally movable and horizontally biased, a top engaged with the base, and a dial secured between the top and the base and freely rotatable therebetween, the dial including one or more recesses in a bottom surface thereof, the finger of the base engaging a recess of the dial when horizontal and disengaging the recess of the dial by pivoting when the dial rotates.

24 Claims, 5 Drawing Sheets

RANDOM OUTCOME GENERATOR FOR GAMES

CROSS-REFERENCE TO RELATED APPLICATIONS

This application claims priority to U.S. Provisional Patent Application No. 61/911,234, filed Dec. 3, 2013, the entire disclosure of which is expressly incorporated herein by reference.

BACKGROUND

Field of the Disclosure

The present disclosure relates to a random outcome generator for games. More specifically, the present disclosure relates to a random indicia generator using a rotating dial.

Related Art

Games, particularly board games, typically involve a variety of game pieces and gameplay mechanics. Many of these games, even those requiring strategy, involve elements of chance. The elements of chance in games can come from cards, dice, spinners, etc.

What would be desirable, but has not yet been developed, is a random outcome generator for games. More specifically, what would be desirable is a random outcome generator that uses a dial and/or to which a figure could be attached and used as a game piece.

SUMMARY

The present disclosure relates to a random outcome generator for games. More specifically, the disclosure relates to a random indicia generator that uses a rotating dial. The dial is secured between a top and a base, and freely rotatable therebetween. The dial includes indicia along an upper surface. The dial spins about a center point. The dial has a plurality of discrete stopping points aligned to position one or more indicia at a designated location with respect to the top. The top includes a window through which one or more indicia can be viewed. A figure or other object can be permanently, or removably, attached to the top.

BRIEF DESCRIPTION OF THE DRAWINGS

The foregoing features of the disclosure will be apparent from the following Detailed Description, taken in connection with the accompanying drawings, in which.

DETAILED DESCRIPTION

The present disclosure relates to a random outcome generator for games, as discussed below in connection with FIGS. 1-6B. The random outcome generator could be used with a game (e.g., board game) that requires chance to progress gameplay.

Figure 1:
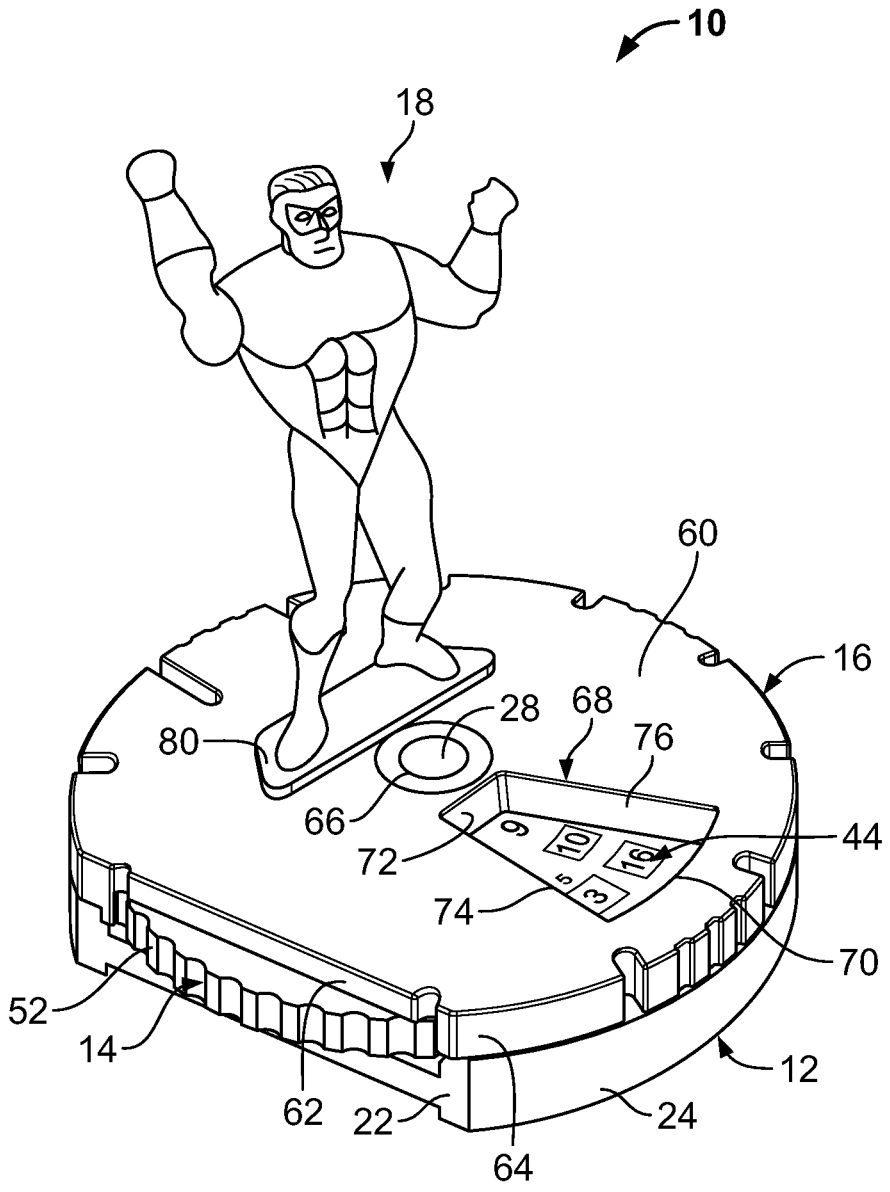
FIG. 1 is a perspective view of a random outcome generator with a figure attached thereto.
Figure 2:
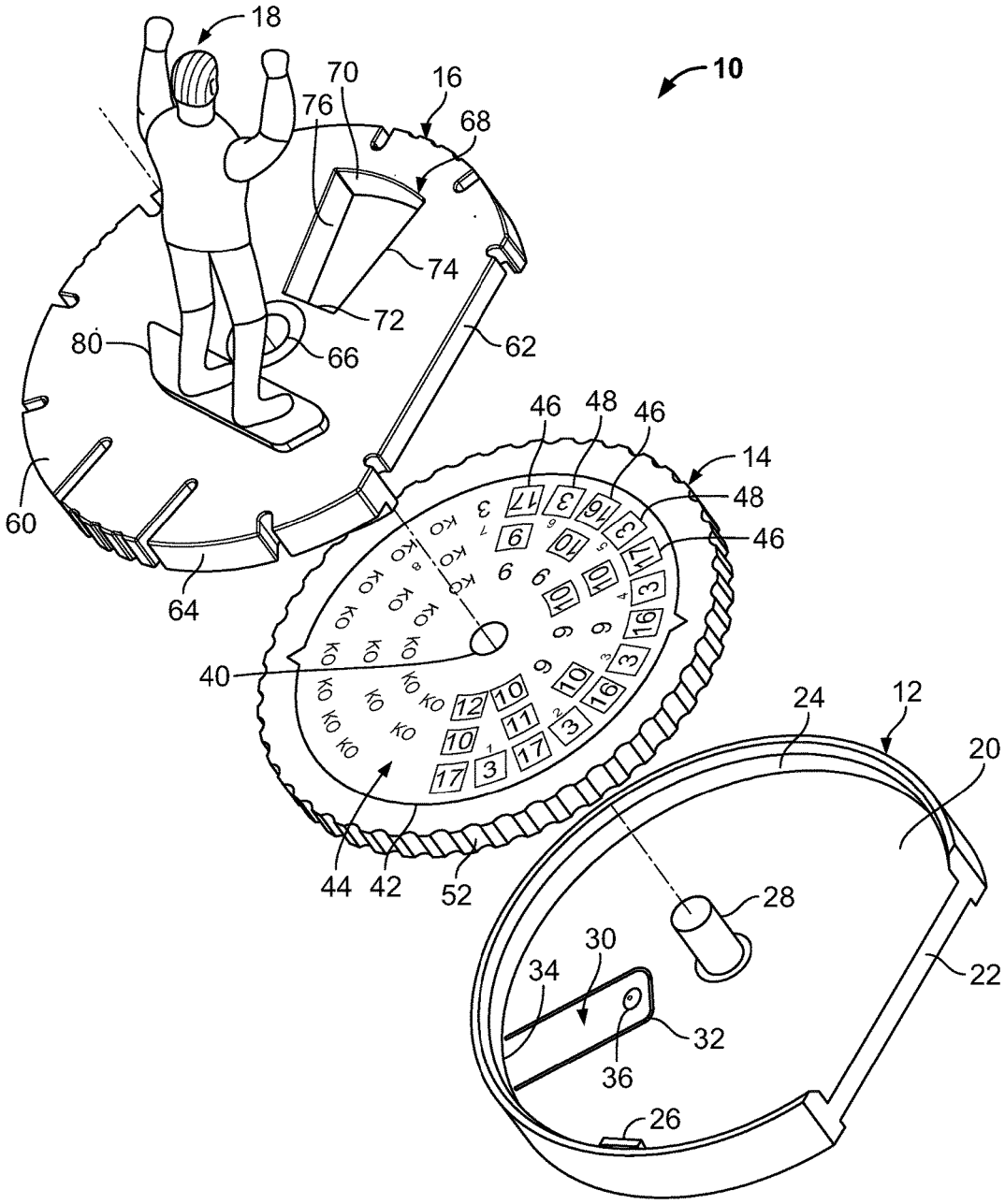
FIG. 2 is an exploded perspective view of the random outcome generator of FIG. 1.

FIGS. 1-2 show a random outcome generator 10 with a figure 18 attached thereto. More specifically, FIG. 1 is an assembled view of the random outcome generator 10 with a figure 18 attached thereto. The figure 18 could be an action figure or game piece. The figure 18 could be any suitable figure (e.g., superhero, action hero, princess, etc.). The figure 18 could be attached to the top 16 of the random outcome generator 10, such as by the base 80 of the figure 18. The figure 18 could be selectively reattachable (e.g., hook and loop fasteners, plastic snaps, etc.) or permanently attached (e.g., glue) depending on the requirements or design of the game. In other words, the figure 18 could be removable and replaceable with another figure. For example, the game could require several central figures 80 (e.g., characters) each with their own random outcome generator 10, to which a figure 80 could be permanently attached. Alternatively, the figure 80 could be reattachable and interchangeable, such as in U.S. Patent Application No. 61/704,280 and Ser. No. 14/033,712 for a Game Piece with Swappable Bases (published as U.S. Patent Application Publication No. 2014/0084542) and U.S. patent application Ser. No. 10/243,980 for a game Piece and Method of Playing a Game and Supplying a Game Piece (issued as U.S. Pat. No. 6,899,333), the disclosures of which are incorporated herein by reference.

The random outcome generator 10 includes a housing having a base 12, a dial 14, and a top 16 engaged with the base 12 securing the dial 14 therebetween. The figure 18, if any, can be attached to the top 16. The dial 14 is secured between the top 16 and the base 12 by an axle attached to one of the top 16 or base 12 that is received by a central aperture 40 of the dial 14 and about which the dial 14 can rotate.

FIG. 2 is an exploded view of the random indicia generator of FIG. 1. The base 12 includes a bottom wall 20, which is generally circular but has a flat side 22 as part of its perimeter. A base sidewall 24 extends about the curved perimeter of the top surface of the bottom wall 20. An axle 28 extends from the top surface of the base 12, for receiving the central aperture 40 of the dial 14 thereon. However, the axle 28 could extend from the top 16 or the dial 14 could otherwise be positioned and retained within the housing.

A finger 30 is defined in the bottom wall 20 by a generally U-shaped perimeter 32 that is disconnected from the bottom wall 20, such that the finger 30 is pivotally movable about pivot edge 34 at the bottom wall 20 of the base 12 between the ends of the perimeter 32. The pivot edge 34 can be at or near the base sidewall 24, so that the finger 30 extends towards the center of the base 12 from the base sidewall 24. The finger 30 includes a stopper 36 extending from the top surface of the finger 30 opposite the pivot edge 34.

The dial 14 includes an axle or central aperture 40 which receives the axle 28 of the base 12 and thereby allows the dial 14 to rotate freely about the axle 28. The dial 14 further includes outer ridges 52 along the perimeter of the dial 14, and recesses (discussed in more detail below). The dial 14 further includes a top surface 42 with indicia 44 radially and cyclically positioned around the top surface 42 at regular intervals. The indicia 44 could be applied to the dial 14 by any of a variety of suitable means (e.g., printing, adhering a decal, etc.). The indicia 44 could include any of a variety of letters, numbers, symbols, etc., as the rules of the game may require. In this way, the indicia 44 could include numbers of varying values, physical sizes, colors, or other graphical display (e.g., numbers positioned within a particular shape). For example, as shown in FIG. 2, indicia 44 include "KO" (knockout) along with numbers of varying values, sizes, and graphical display (e.g., numbers with and without boundaries around them) concentrically positioned and radially aligned about the dial 14 (e.g., outside position, intermediate position, and inside position). Also, there could be a long column 46 of indicia 44 (e.g., a column having a plurality of numbers) and a short column 48 of indicia (e.g., a column having less numbers), where the long and short columns 46, 48 alternate around the dial 14.

The top 16 includes a top wall 60, which is generally circular but has a flat side 62 as part of its perimeter. A top sidewall 64 extends from the curved perimeter of the bottom surface of the top wall 60. The flat side 62 does not include a sidewall 64. The top 16 and the base 14 engage one another so that the flat side 62 of the top 16 aligns with the flat side 22 of the base 12. The top 16 could further include an axle aperture 66 for receiving the axle 28 of the base 12. A top recess (not shown) could be provided on the inner surface of the top sidewall 64 for receiving the engagement key 26 of the base sidewall 24, thereby securing the base 12 to the top 16 with the dial 14 therebetween. Alternatively, the top 16 could include a top engagement key (not shown) which interacts with the base engagement key 26 to prevent rotation of top 16 relative to the base 12. Further, the inside of the top sidewall 64 could include a ridge that could correspond to and engage with a ridge on the inside of the base sidewall 24. The top 26 could be removably or permanently attached to the base 12 so that the dial 14 could be replaceable or permanently affixed therein. The diameter of the dial 14 is less than the inner diameter of the bottom wall 20 and the top wall 60, so that the dial 14 is freely rotatable when secured between the top 16 and the base 14.

The top 16 includes a window 68 formed in the top wall 60 of the top 16 to allow a user to view a portion of the indicia 44 on the dial 14, and at the same time, the top wall 60 hides the remainder of the indicia 44. This could provide a unique gameplay mechanic where a user has to choose from one of several random outcome generators 10 and/or dials 14. Thereby, the user, and/or his opponents, may not know which generator 10 and/or dial 14 the user has chosen or all of the indicia 44 on that dial 14. This could add to the replay value of a game because it makes each game session more unique, and not fully knowing a key component (e.g., which generator 10 or which dial 14 a user has chosen) can alter the strategy of the players.

The window 68 can be generally trapezoidal, as shown, having a first wall 70 farther from the center, a second wall 72 positioned closer to the center, and a third wall 74 and fourth wall 76 therebetween, and which depend from the top surface of the top 16. The walls of the window 68 could be tapered, and indicia could be placed proximate to one or more of the walls and correspond to the positions of indicia 44 on the dial 14. The generally trapezoidal shape of the window 68 allows only, and both, one long column 46 and a neighboring short column 48 to be seen through the window 68 at a time. Although the window 68 is generally trapezoidal, any shaped window 68 could be used.

As shown in FIG. 1, when the top 16 and the base 12 are engaged, with the dial 14 secured therebetween, a portion of the perimeter of the dial 14 protrudes from an opening formed between the flat side 22 of the base 20 and the flat side 62 of the top 16. This provides a user access to the perimeter of the dial 14 to apply a force to the perimeter of the dial 14 to spin the dial 14 within the top 16 and base 12. When the dial 14 randomly comes to rest when the stopper engages a recess, as will be described, a user can view the corresponding indicia 44 through the window 68 of the top 16.

Figure 3:
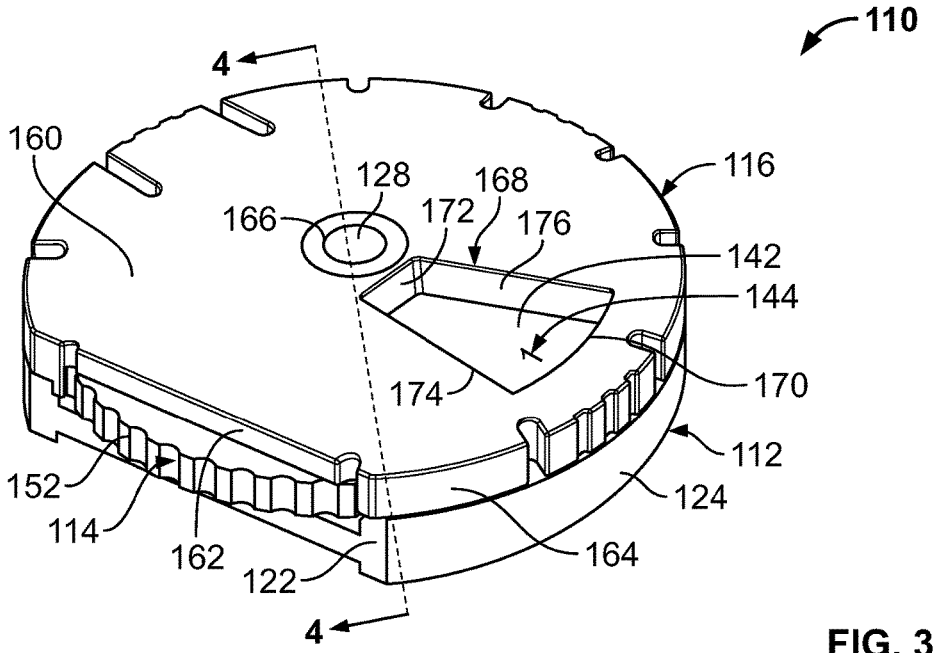
FIG. 3 is a perspective view of another random outcome generator.
Figure 4:
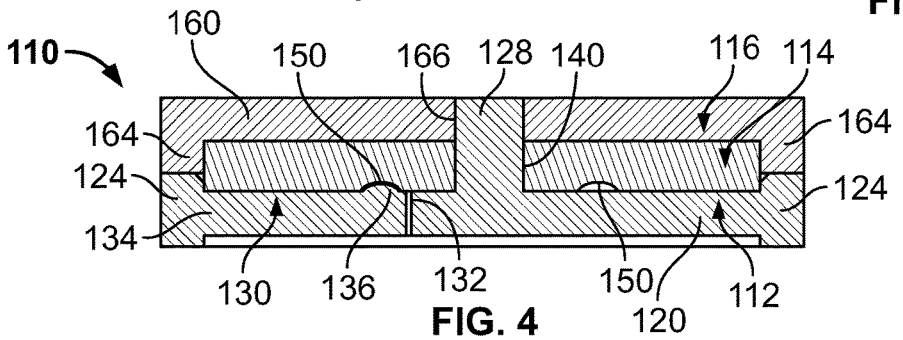
FIG. 4 is a cross-sectional view of the random outcome generator of FIG. 3 taken along line 4-4.

FIGS. 3-4 are views of another embodiment of the random outcome generator 110. More specifically, FIG. 3 is an assembled perspective view of another embodiment of the random outcome generator 110. Consistent with the random outcome generator of FIGS. 1-2, the random outcome generator 110 includes a base 112, a dial 114 secured to the base 112, and a top 116 engaged with the base 112 securing the dial 114 therebetween. As in FIGS. 1-2, the base 112 includes a bottom wall 120 with a flat side 122, a base sidewall 124, an axle 28, and a finger 130 defined in the bottom wall 120 by a separation 132, attached at pivot edge 134, and which includes a stopper 136 opposite the pivot edge 134. The top 116 includes a top wall 160 with a flat side 162, a top sidewall 164, an axle aperture 166, and a window 168 having a first wall 170, second wall 172, third wall 174, and fourth wall 176. The dial 114 includes an axle aperture 140, a top surface 42 having indicia 144, and outer ridges 152.

FIG. 4 is a cross-sectional view of the random outcome generator of FIG. 3 (although the view would be substantially the same for the random outcome generator of FIGS. 1-2). As shown, the dial includes recesses 150 on the lower surface thereof (shown in more detail below). Finger 130 is horizontally biased (as shown in FIG. 4). When horizontal, the stopper 136 of the finger 130 engages one of the recesses 150 of the dial 114. As the dial 114 rotates, the stopper 136 disengages the recess 150 forcing the finger 130 (and stopper 136) to pivot away from the dial 114. The base sidewall 124 extends from the bottom surface of the bottom wall 120 to provide enough room beneath the base 112 for the finger 130 to pivot when the random outcome generator 110 is used on a flat surface (e.g., table). As the dial 114 continues to rotate, the stopper 136 continues to engage and disengage the recesses 150, thereby making a clicking sound. The rotation of the dial 114 slows down until the stopper 136 finally engages a last recess 150 and the dial 114 stops spinning. The position of each of the recesses 150 corresponds with position of indicia 144 of the dial 114, such that when the stopper 136 engages a final recess 150 at least a portion of the indicia 144 is positioned and viewable through window 168.

Figure 5A:
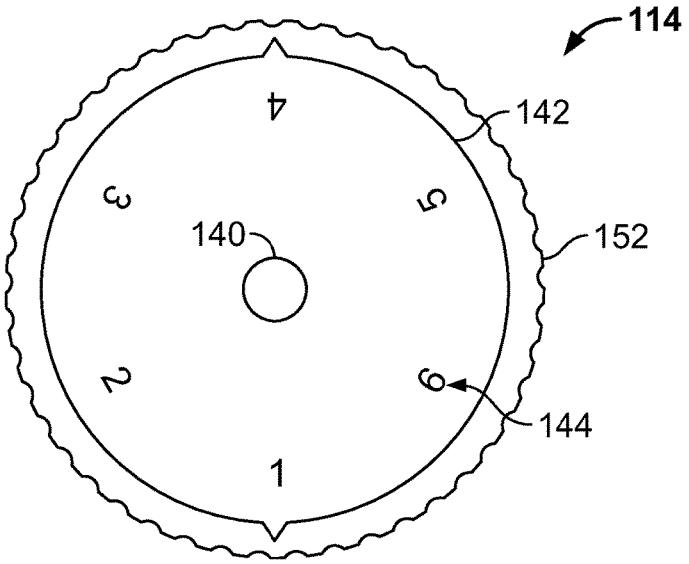
FIG. 5A is a top view of a dial of the random outcome generator of FIG. 3.
Figure 5B:
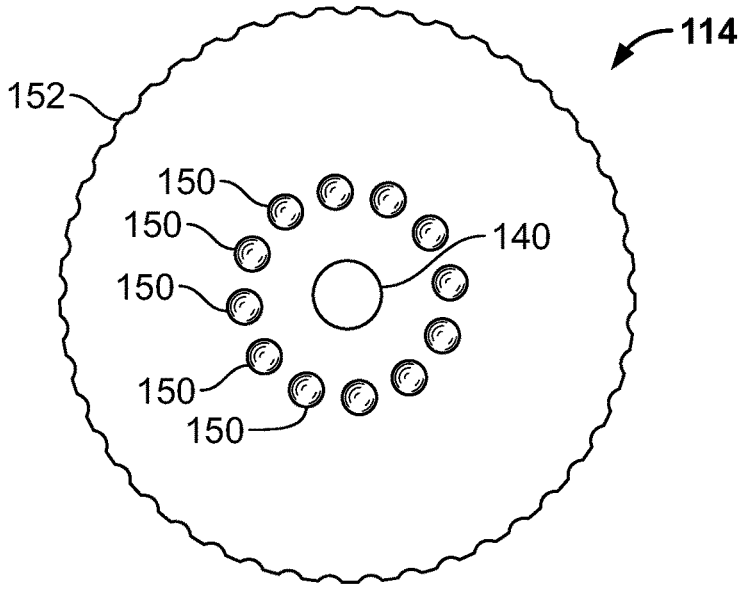
FIG. 5B is a bottom view of the dial of the random outcome generator of FIG. 3.
Figure 5C:
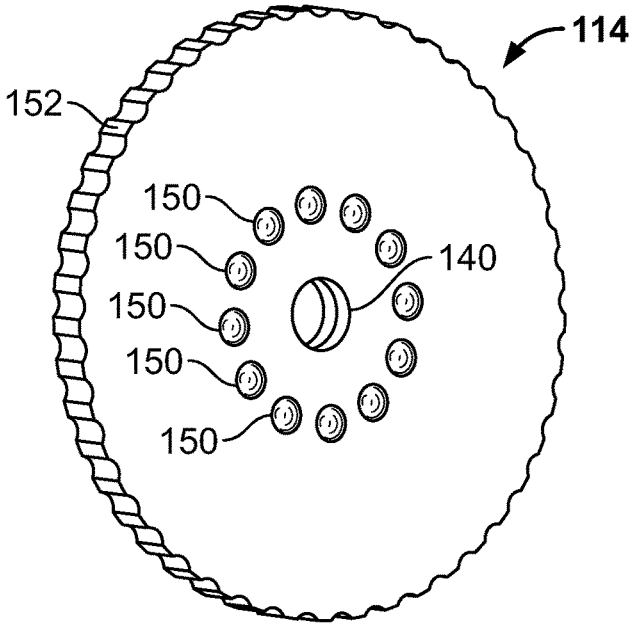
FIG. 5C is a bottom perspective view of the dial of the random outcome generator of FIG. 3.

FIG. 5A-5C are views of the dial 114 of FIG. 3 (although the dial 114 is substantially similar to the dial of FIGS. 1-2). More specifically, FIG. 5A is a top view of the dial 114 of FIG. 3 having an axle aperture 140, a top surface 142, indicia 144, and outer ridges 152. The indicia 144 are numbers 1 through 6 positioned around the dial 114. FIG. 5B is a bottom view of the dial of FIG. 3 showing recesses 150 rotating positioned around the dial 114, such that each is radially positioned the same distance from central aperture 140 so that each aperture can engage with the stopper of the finger of the base. The intervals at which the recesses 150 are positioned, as discussed above, to correspond with the number of, and desired position of, indicia 144 of the top surface 142 through the window of the top. FIG. 5C is a perspective view of the bottom surface of the dial 114 of FIG. 3 showing recesses 150 therein.

Figure 6A:
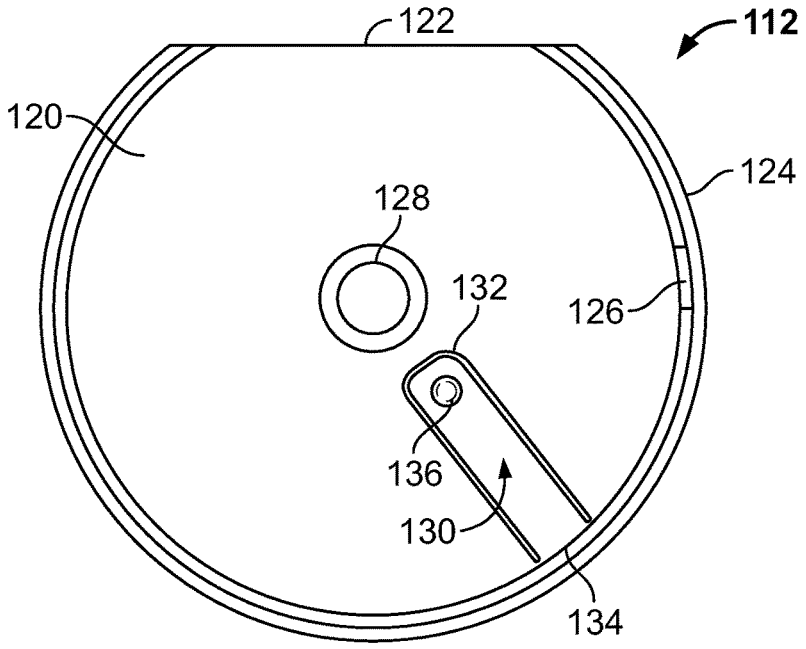
FIG. 6A is a top view of the base of a random outcome generator.
Figure 6B:
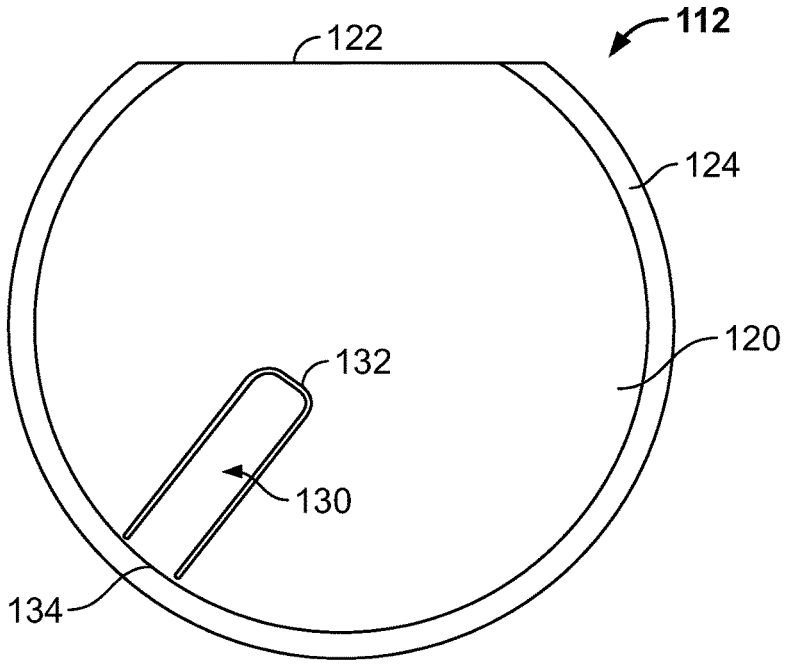
FIG. 6B is a bottom view of the base of a random outcome generator.

FIG. 6A-6B are views of the base 112 of the dial of FIGS. 3-4 (although the base is the same for the dial of FIGS. 1-2). More specifically, FIG. 6A is a top view of the base 112. Consistent with the random outcome generator of FIGS. 1-4, the base 112 includes a bottom wall 120 with a flat side 122, a base sidewall 124, an axle 128, an engagement key 126, and a finger 130 defined in the bottom wall 120 by a separation 132, attached to the bottom wall 120 at pivot edge 134, and which includes a stopper 136 opposite the pivot edge 134. FIG. 6B is a bottom view of the base 112 showing that the separation 132 of the panel 130 extends through the bottom wall 120 of the base 112.

Having thus described the system and method in detail, it is to be understood that the foregoing description is not intended to limit the spirit or scope thereof. It will be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure.

What is claimed is:

1. A random outcome generator for a game comprising:

a base including a perimeter that is generally circular with a flat side, the base having a bottom wall defining a finger therein, the finger including a stopper extending from a top surface thereof;

a top including a perimeter that is generally circular with a flat side, the top engaged with the base with the flat side of the top perimeter aligned with the flat side of the base perimeter, and the generally circular perimeter of the base aligned with the generally circular perimeter of the base;

an opening formed between the flat side of the base and the flat side of the top; and a dial secured between the top and the base and freely rotatable therebetween, the dial including one or more recesses in a bottom surface thereof, the finger spaced radially away from the opening and positioned adjacent the circular side of the base, the finger biased to urge the stopper into a recess of the dial, and the finger pivotally movable to disengage the stopper from the recess of the dial when the dial rotates.

2. The random outcome generator of claim 1, wherein the top includes a top wall forming a window therein.

3. The random outcome generator of claim 2, wherein the window is generally trapezoidal.

4. The random outcome generator of claim 2, wherein the dial includes one or more indicia on a top surface thereof, and at least a portion of the indicia are viewable through the window of the top.

5. The random outcome generator of claim 4, wherein the one or more indicia are radially and cyclically positioned around the top surface of the dial at regular intervals.

6. The random outcome generator of claim 4, wherein the one or more indicia include graphics or numbers.

7. The random outcome generator of claim 1, further comprising a figure attached to the top.

8. The random outcome generator of claim 7, wherein the figure is reattachable.

9. The random outcome generator of claim 1, wherein the base further comprises an axle extending from the base to a receptacle in the top wall of the top.

10. The random outcome generator of claim 9, wherein the dial includes a central aperture to receive the axle of the base.

11. The random outcome generator of claim 1, wherein the base includes a base sidewall extending about a circular portion of a perimeter of the bottom wall, and the top includes a top sidewall extending about a circular portion of a perimeter of the top wall.

12. The random outcome generator of claim 1, wherein a portion of the perimeter of the dial protrudes from the opening formed between the flat side of the base and the flat side of the top.

13. The random outcome generator of claim 1, wherein the dial includes ridges along a perimeter thereof.

14. A random outcome generator for a game comprising:

a base including a perimeter that is generally circular with a flat side, the base having a bottom wall defining a finger therein, the finger including a stopper extending from a top surface thereof;

a top including a perimeter that is generally circular with a flat side, the top engaged with the base with the flat side of the top perimeter aligned with the flat side of the base perimeter, and the generally circular perimeter of the base aligned with the generally circular perimeter of the base, the top having a top wall forming a window therein;

an opening formed between the flat side of the base and the flat side of the top; and a dial secured between the top and the base and freely rotatable therebetween, the dial including one or more indicia on a top surface thereof at least a portion of which are viewable through the window of the top, the dial including one or more recesses in a bottom surface thereof, the finger spaced radially away from the opening and positioned adjacent the circular side of the base, the finger biased to urge the stopper into a recess of the dial, and the finger pivotally movable to disengage the stopper from the recess of the dial when the dial rotates.

15. The random outcome generator of claim 14, wherein the window is generally trapezoidal.

16. The random outcome generator of claim 15, wherein the one or more indicia are radially and cyclically positioned around the top surface of the dial at regular intervals.

17. The random outcome generator of claim 15, wherein the one or more indicia include graphics or numbers.

18. The random outcome generator of claim 14, further comprising a figure attached to the top.

19. The random outcome generator of claim 18, wherein the figure is removable and replaceable.

20. The random outcome generator of claim 14, wherein the base further comprises an axle extending from the base to a receptacle in the top wall of the top.

21. The random outcome generator of claim 20, wherein the dial includes a central aperture to receive the axle of the base.

22. The random outcome generator of claim 14, wherein the base includes a base sidewall extending about a circular portion of a perimeter of the bottom wall, and the top includes a top sidewall extending about a circular portion of a perimeter of the top wall.

23. The random outcome generator of claim 14, wherein a portion of the perimeter of the dial protrudes from the opening formed between the flat side of the base and the flat side of the top.

24. The random outcome generator of claim 14, wherein the dial includes ridges along a perimeter thereof.

* * * * *